United States Patent [19]

Ebihara

[11] 4,208,866

[45] Jun. 24, 1980

[54] ELECTRONIC TIMEPIECE EQUIPPED WITH ALARM

[75] Inventor: Heihachiro Ebihara, Tokorozawa, Japan

[73] Assignee: Citizen Watch Company Limited, Tokyo, Japan

[21] Appl. No.: 921,954

[22] Filed: Jul. 5, 1978

[30] Foreign Application Priority Data

Jul. 8, 1977 [JP] Japan ..... 52-81805

[51] Int. Cl.[2] ..... G04C 21/16; G04C 21/00; G04B 23/12

[52] U.S. Cl. ..... 368/251; 368/73

[58] Field of Search ..... 58/16, 19 R, 19 B, 19 A, 58/21.13, 21.15, 21.155, 22.9, 38 R, 57.5, 39.5, 126 R, 126 D, 152 B

[56] References Cited

U.S. PATENT DOCUMENTS

| | | | |
|---|---|---|---|
| 507,959 | 10/1893 | Wtman | 58/19 B |
| 3,545,196 | 12/1970 | Vazzano et al. | 58/19 R |
| 3,738,098 | 6/1973 | Scheer | 58/19 R |
| 3,745,761 | 7/1973 | Tsuruishi | 58/38 |
| 3,834,153 | 9/1974 | Yoda et al. | 58/38 |

*Primary Examiner*—Vit W. Miska

*Attorney, Agent, or Firm*—Holman & Stern

[57] ABSTRACT

In an analog type of timepiece equipped with an alarm, an alarm time coincidence detection mechanism and a zero seconds detection mechanism are provided whereby switch contacts are closed when alarm time coincidence and zero seconds are detected respectively. A logical product is formed by combining signals from said switch contacts such that an operating signal to actuate an alarm device is produced with a high degree of accuracy. A memory circuit is incorporated to eliminate the effects of imperfect switch contact.

8 Claims, 10 Drawing Figures

Fig. 2

Fig. 8
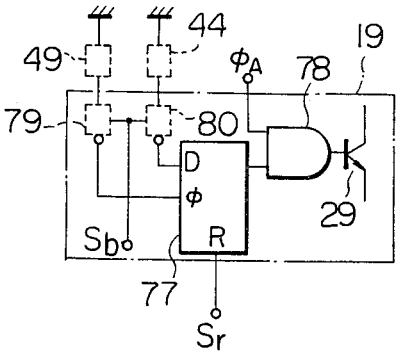
Fig. 9
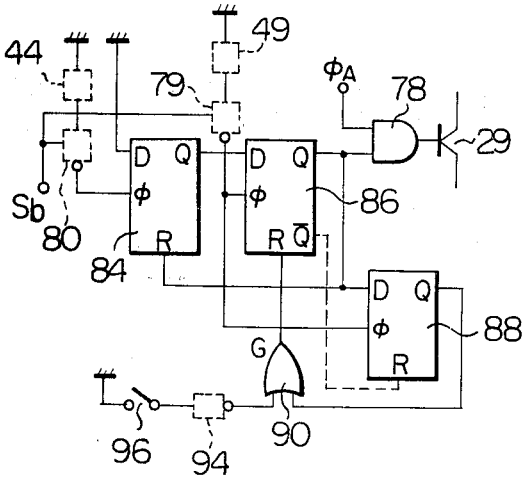
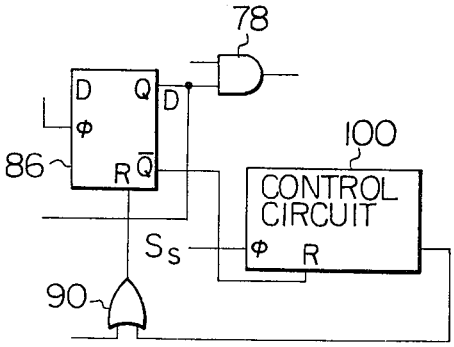
Fig. 10

ELECTRONIC TIMEPIECE EQUIPPED WITH ALARM

This invention relates to analogue type timepieces equipped with an alarm device, and more particularly to an analogue type timepiece equipped with an alarm device and electronic circuit means coupled to mechanical type zero seconds detection and alarm time coincidence detection means whereby an alarm signal is generated with a high degree of accuracy relative to a preset alarm time.

In the case of a conventional type of mechanical timepiece equipped with an alarm device, since the timekeeping accuracy itself is not normally extremely high, a high accuracy for the alarm signal generation time cannot be expected. This is due to a variety of causes. The alarm setting mechanism is usually very simple, with the preset alarm time being indicated by a single hand on the timepiece display dial. For such a timepiece, it is difficult to obtain an alarm generation time accuracy of better than plus or minus 5 minutes with respect to the preset alarm time.

Recently however, various types of electronic timepiece of analogue type have been developed. Such timepieces can have a timekeeping accuracy of the order of plus or minus 15 seconds per month, or better. Since time information can be provided to such extremely high accuracy by such a timepiece, similarly high accuracy is required for alarm signal generation time. There have been various attempts to achieve this, for example by using a dual type of alarm time display, with two hands instead of one. However, since mechanical elements are utilized, cumulative errors are produced which result in a total error of alarm signal generation time of the order of plus or minus one minute. Such an error appears to be unavoidable, when the alarm mechanism utilizes purely mechanically coupled elements. Also, the error is not consistent, so that the user may experience inconvenience in utilizing such a timepiece.

With a timepiece in accordance with the present invention, detection of alarm time coincidence is performed by two sets of switch contacts corresponding to hours and minutes respectively, connected in series, being closed simultaneously. Detection of the zero seconds condition of the current time is detected by another pair of switch contacts being closed. The zero seconds detection switch contacts and the alarm time coincidence detection switch contacts are logically ANDed (i.e. their logical product is formed). This can be done, for example, by connecting them in series. Thus, when the zero seconds condition and alarm time coincidence conditions occur simultaneously, a conducting path is formed between the three sets of switch contacts, i.e. the alarm time coincidence detection switch contacts and the zero seconds detection switch contacts. This fact is used to generate an alarm signal by actuating an alarm device.

Such a system is susceptible to the effects of insufficient switch contact, due to such causes as switch bounce etc., if the drive current for the alarm device is passed directly through the switch contacts. With the method of the present invention, therefore, an output signal from the switch contacts is used to trigger a latch type of memory circuit, which is periodically reset by a clock signal. Thus, even if only insufficient switch contact occurs after alarm time coincidence and zero seconds are detected, an alarm signal can be generated by the alarm device for a predetermined period of time.

It is therefore an object of the present invention to provide an improved analog type electronic timepiece equipped with an alarm function.

More particularly, it is an object of the present invention to provide an improved analog type electronic timepiece equipped with an alarm function whereby detection of alarm time coincidence and of zero seconds causes an electronic circuit to actuate an alarm device, with a high degree of time accuracy.

Other objects, features and advantages of the present invention will be made more apparent by the following description, when taken in conjunction with the attached figures, wherein:

FIG. 8 is a circuit diagram of a fifth embodiment of an alarm signal control system in accordance with the present invention;

FIG. 9 is a circuit diagram of a sixth embodiment of an alarm signal control system in accordance with the present invention; and FIG. 10 is a circuit diagram of a modification of the circuit of FIG. 9 whereby the duration of generation of an alarm signal can be controlled as desired.

Figure 1:
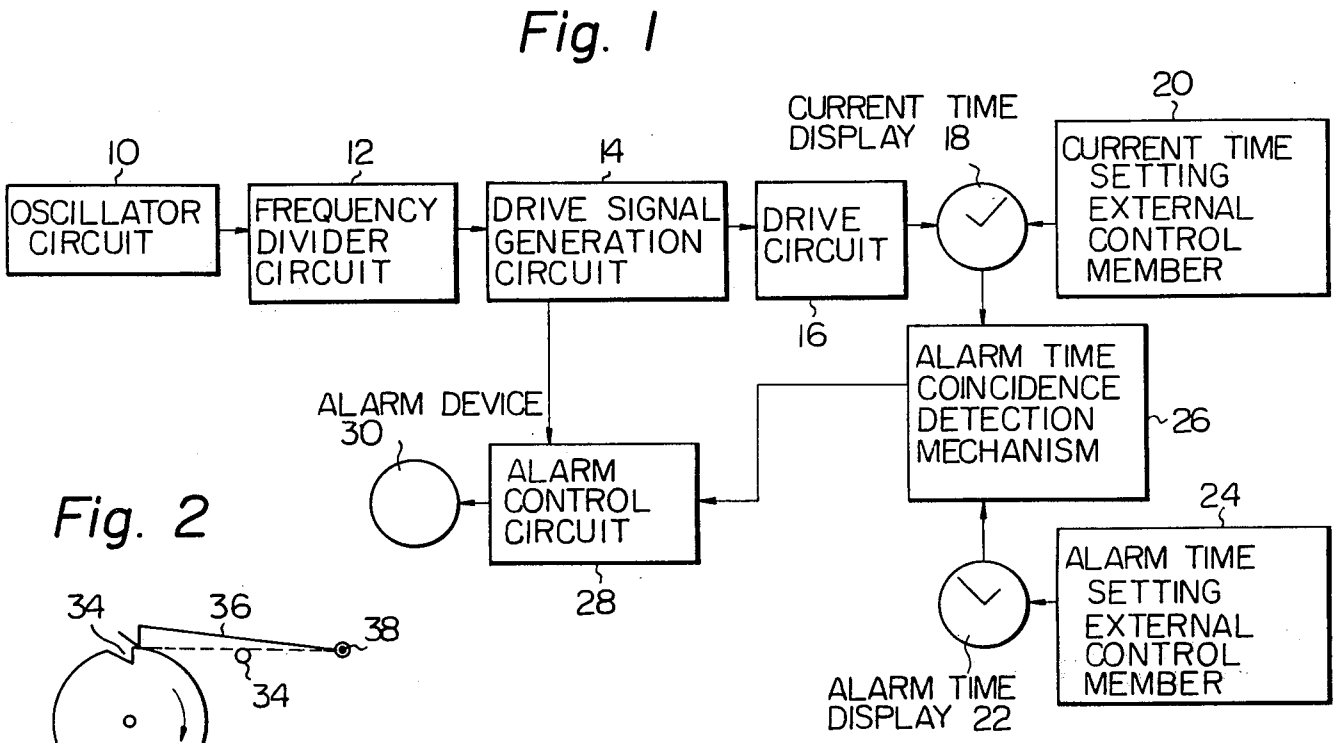
FIG. 1 is a general block diagram of a conventional type of analog type electronic timepiece equipped with an alarm function.

Referring now to FIG. 1, a general block diagram is shown therein of a typical analogue timepiece equipped with an alarm function. A high frequency standard signal is produced by an oscillator circuit 10, and applied to a frequency divider circuit 12. A standard time signal produced by frequency divider circuit 12 is applied to drive signal generation circuit 14, which produces drive signals to actuate a motor 16. Motor 16 operates the hours, minutes and seconds hands of a current time display 18, so that the timepiece displays the current time. This time can be set by means of current time setting external operating member 20. Numeral 22 indicates an alarm time display, on which a preset alarm time is displayed, by means of one or more hands. An alarm time can be set in by actuation of alarm time setting external control member 24. When the current time and the alarm time become identical, then this is detected by means of alarm time coincidence detection mechanism 26, which then generetes an alarm time coincidence signal that is applied to alarm control circuit 28. Alarm control circuit 28 is thereby caused to drive alarm device 30, by a drive signal produced by means of an input signal from drive signal generation circuit 14. In other words, the frequency and other characteristics of the alarm signal generated by alarm device 30 are controlled by the input to alarm control circuit 28 from drive signal generation circuit 14, while the time at which generation of the alarm signal begins is controlled by the timing of the input to alarm control circuit 28 from alarm time coincidence mechanism 26.

A system such as that described above has the disadvantage that the time at which an alarm signal is generated by alarm device 30 is not precisely controlled, i.e. there can be a difference of several tens of seconds between the precise alarm time which has been set in alarm time display 22 and the point in time at which the alarm signal starts to be generated. Also, this time error is not consistent, so that it cannot be allowed for by the timepiece user.

Another disadvantage of such a system as is shown in FIG. 1 is that, once the alarm signal has started to be generated, if the user omits to switch off the alarm signal manually, then it will continue to be generated for a total time duration of up to one minute. The amount of power consumed by the miniature alarm buzzer used in an electronic timepiece is fairly substantial, especially in the case of a small wristwatch which incorporates a miniature battery as a power source. Thus, it is possible for the battery lifetime to be affected by the operation of the alarm system in such a timepiece.

Figure 2:
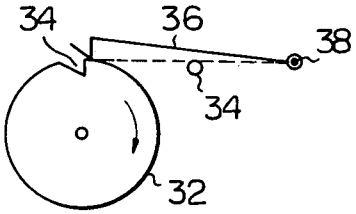
FIG. 2 is an example of a mechanical type of zero seconds detection mechanism.

Referring now to FIG. 2, an example is shown therein of a type of mechanism which is suitable for use as a zero seconds detection mechanism in an electronic timepiece in accordance with the present invention. A cam 32 contains a notched section 34. Cam 32 is rotated at a speed of one revolution per minute. A spring member 36, shaped as shown in the diagram, is attached at one end to a securing post 38, while a protruding portion of the other end of spring member 36 is held in contact with the circumference of cam 32. It will be apparent that, once in every 60 seconds, the protruding portion of spring 36 will drop into the notched section of cam 32. Electrical contact is thereby established between spring 36 and contact 34, in other words the device functions as a switch, whose contacts are closed once in every 60 seconds. It can therefore be used to detect the occurrence of the zero seconds position of the seconds hand of a timepiece, since cam 32 can be driven in synchronism with the minutes hand of the timepiece.

Figure 3:
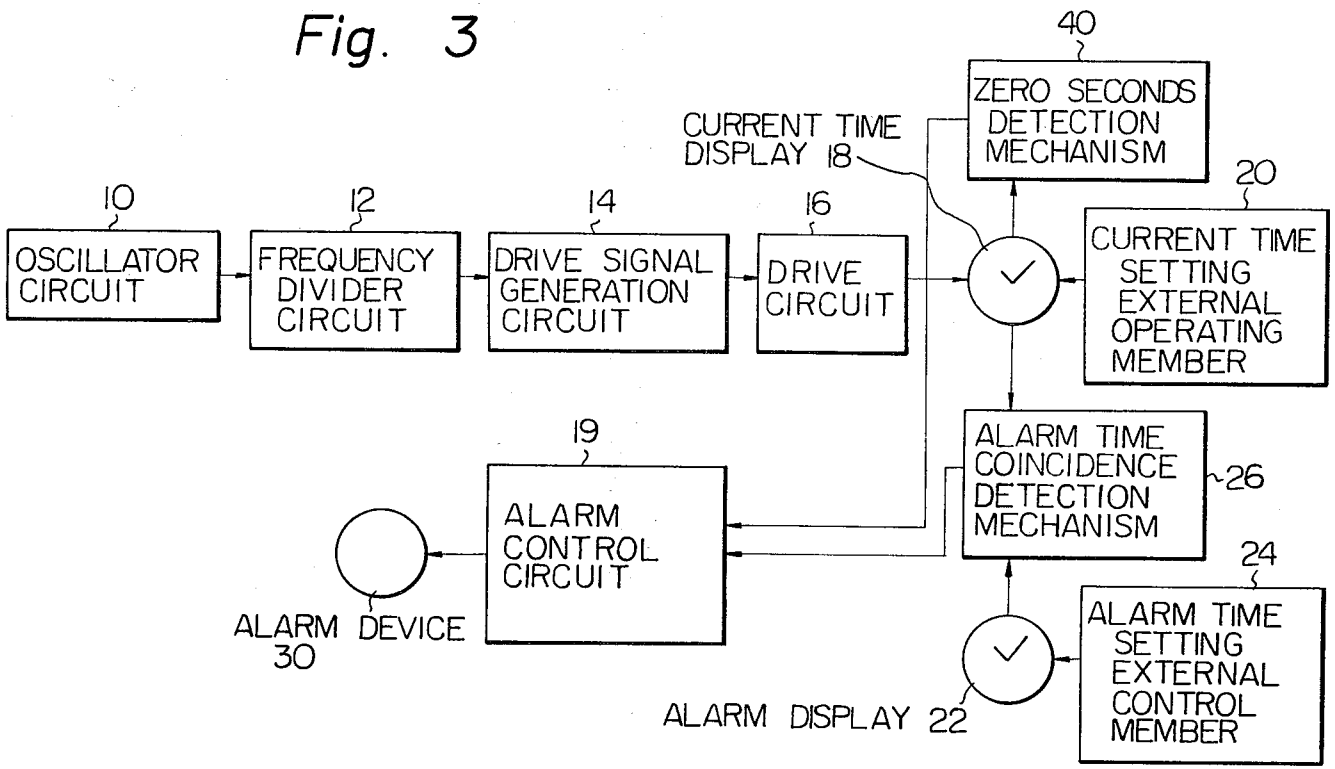
FIG. 3 is a general block diagram of an electronic timepiece of analog type equipped with an alarm function in accordance with the present invention.

Referring now to FIG. 3, a general block diagram is shown therein of an analog type electronic timepiece incorporating an alarm signal control system in accordance with the present invention. This diagram is similar to FIG. 1 described above, and blocks and components having the same functions as in FIG. 1 have the same numerals attached. A point of difference from the arrangement shown in FIG. 1 is the incorporation of a zero seconds detection mechanism 40, which can be of the type described above in relation to FIG. 2. With the present invention, an output signal from zero seconds detection mechanism 40 and an output signal from alarm time coincidence detection mechanism 26 are combined as a logical product to control the functioning of alarm control circuit 19. In other words, if both alarm time coincidence and the zero seconds condition are detected simultaneously, then alarm control circuit 19 is actuated. As a result, alarm device 30 is caused to generate an alarm signal in accordance with the input signal applied to alarm control circuit 19 from drive signal generation circuit 14.

It will be apparent that, if an alarm signal is generated only when the conditions of zero seconds being detected and alarm time coincidence being detected are both satisfied, then consistent and accurate timing of the generation of alarm signals will be obtained. In the following, various practical embodiments of alarm signal control systems which are applicable to a timepiece arrangement as shown in FIG. 3 will be described. For clarity of description, only the actual components and circuit connections required for alarm signal control will be described.

Figure 4:
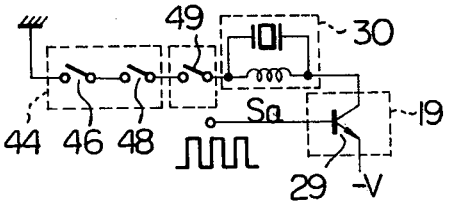
FIG. 4 is a circuit diagram of an embodiment of an alarm signal control system in accordance with the present invention.

Referring now to FIG. 4, the series-connected pairs of switch contacts 46 and 48 correspond to the alarm time coincidence detection mechanism 26 shown in FIG. 3. When the minutes of the current time coincide with the minutes of the alarm time set in alarm display 22, then switch contacts 46 are closed. When the hours of the current time coincide with the hours of the alarm time, then switch contacts 48 are closed. Switch contacts 49 correspond to zero seconds detection mechanism 40 shown in FIG. 3. When the seconds hand of current time display 18 reaches the zero position, then contacts 49 are closed. Switch contacts 49 can be part of a zero seconds detection mechanism as illustrated in FIG. 2 above. With this circuit arrangement, all of switch contacts 46, 48 and 49 connected in series become closed when the hour and minutes of the current time become equal to the hour and minutes of the alarm time which has been set. One terminal of alarm device 30 thereby becomes connected to the high potential of the timepiece battery. This potential will be referred to hereinafter as the H level. For the embodiments of the present invention described herein, the H level corresponds to ground potential, since the positive terminal of the battery is connected to ground.

The other end of alarm device 30 is connected to alarm control circuit 19, which in this case is shown as comprising a transistor 29. Signal Sa is applied to the control terminal of alarm control device 29. Thus, when alarm time coincidence is detected and also zero seconds is detected, current is caused to flow periodically through alarm device 30 via switch contacts 46, 48 and 49, through alarm control device 29, to the L potential. Alarm device 30 is thereby actuated causing an audible warning signal to be generated as the alarm signal.

This arrangement is extremely simple. However, it has the disadvantage that the current which actuates alarm device 30 flows directly through the switch contacts whereby coincidence is detected. Thus, if intermittent contact occurs, or if a high contact resistance develops for some reason, the operation of the alarm device will be adversely affected. It is therefore desirable to adopt some method whereby it is not necessary for the switch contacts to be absolutely perfect at all times.

Figure 5:
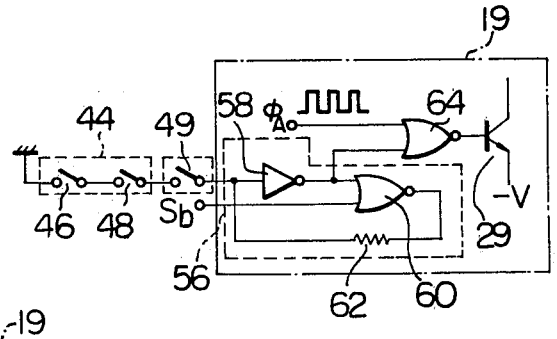
FIG. 5 is a circuit diagram of another embodiment of an alarm signal control system in accordance with the present invention.

The circuit arrangement shown in FIG. 5 is intended to overcome the problem described above of the arrangement of FIG. 4. As in the case of FIG. 4, all of contacts 46, 48 and 49 are closed when the alarm time coincides with the current time, and when zero seconds is detected. When this occurs, an H level signal is applied to memory circuit 56. Memory circuit 56 is a simple latch circuit which forms a part of alarm control circuit 19. The output of inverter 58 is connected to one input terminal of NOR gate 60, while the output of NOR gate 60 is connected back to the input terminal of inverter 58 through a resistor 62. A clock signal Sb is applied to the other input terminal of NOR gate 60.

Clock signal Sb consists of a train of narrow pulses of low duty cycle. Thus, so long as at least one of contacts 46, 48 and 49 is open, the output of inverter 58 is at the H level. This is because the output of NOR gate 60 is repeatedly set to the L level by clock pulses Sb. This L level output is applied to the input of inverter 58 through resistor 62, causing the output of inverter 58 to be at the H level, thereby latching the output of NOR gate 60 at the L level between Sb clock pulses.

When alarm time coincidence is detected, then an H level input is applied to the input of inverter 58, as described above. As a result, the output of inverter 58 goes to the L level, and the output of NOR gate 60 goes to the H level. Thus, even if one or more of switch contacts 46, 48 and 49 should momentarily open, the output from inverter 58 will be held at the L level until a subsequent Sb clock pulse occurs. With this arrangement, therefore, it is not necessary for absolutely perfect switch contact to be achieved. Also, since the signal from the switch contacts is applied to an input of a low power consumption circuit element, such as an MOS inverter, the impedance presented is extremely high. Any switch contact resistance will therefore have virtually no effect upon the operation of the circuit.

The output of inverter 58 is also applied to an input terminal of NOR gate 64 which also forms a part of alarm control circuit 19, clock signal Sa being applied to the other input terminal of this OR gate. When the output from inverter 58 is at the H level, then clock pulses Sa have no effect, since the output terminal of NOR gate 64 is held at the L level. However, when alarm time coincidence is detected so that the output of inverter 58 goes to the L level, as described above, then the output of NOR gate 64 becomes controlled by clock signal Sa, so that a corresponding (inverted) clock signal is applied to alarm control device 29. Alarm device 30 is thereby actuated, as described for the arrangement of FIG. 4.

Figure 6:
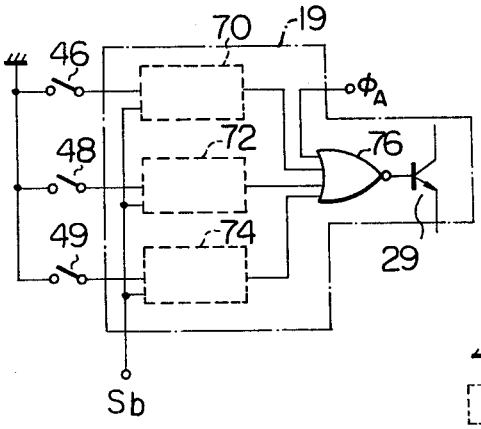
FIG. 6 is a circuit diagram of a third embodiment of an alarm signal control system in accordance with the present invention.

With the embodiment shown in FIG. 6, separate input circuits are provided for each of switchings 46, 48 and 49. Each of input circuits 70, 72 and 74 is of the type shown by numeral 56 in FIG. 5 and forms a part of alarm control circuit 19. The outputs of all of the input circuits are connected to NOR gate 76 which forms a part of alarm control circuit 19. Thus, when alarm time coincidence and zero seconds are detected, all of the outputs of circuits 70, 72 and 74 go to the L level. The inverted clock signal Sa is thereby applied to alarm control circuit 29, thereby actuating the alarm device 30.

In the case of each of the embodiments shown in FIGS. 4, 5 and 6, the maximum duration of the alarm signal is of the order 5 to 10 seconds, or less. This is because the alarm signal is only produced so long as the zero seconds detection condition continues. It will be apparent that if a zero seconds detection mechanism as shown in FIG. 2 is utilized, it is difficult to extend the duration of the zero seconds detection condition. This short duration of the alarm signal presents an inconvenience. To overcome this, the embodiment shown in FIG. 7 can be considered.

Figure 7:
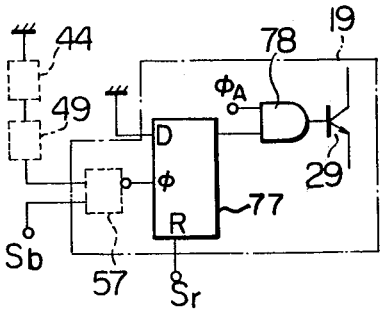
FIG. 7 is a circuit diagram of a fourth embodiment of an alarm signal control system in accordance with the present invention.

In FIG. 7, numeral 44 indicates the combination of series-connected switches 46 and 48 described above. Numeral 57 indicates an input circuit of memory type, as illustrated by the circuit denoted with numeral 56 in FIG. 5, but with the addition of an output inverter stage connected to the output of the circuit denoted by numeral 56. Thus, the output of input circuit 57 is normally at the L level. When alarm time coincidence is detected together with zero seconds being detected, the output of input circuit 57 goes to the H level. The output from input circuit 57 is connected to the clock terminal of data-type flipflop 77 which forms a part of alarm control circuit 19, the data terminal of this flip-flop being connected to the H level of the circuit. At the instant when alarm coincidence and zero seconds are detected, the output of input circuit 57 goes from the L level to the H level. Prior to this instant, the output of flip-flop 77 has been held at the L level, due to the flip-flop being repeatedly reset by the action of reset pulses Sr, which are applied periodically to the reset terminal of flip-flop 77. When the output of input circuit 57 goes to the H level, this causes the H level applied to the data terminal of the flip-flop to be read in, so that the flip-flop output goes to the H level. The output of flip-flop 77 is connected to an input of AND gate 78 which also forms a part at alarm control circuit 19, clock signal Sa being applied to the other input terminal of AND gate 78. Thus, when the output of flip-flop 77 goes to the H level, the output of AND gate 78 beguns to vary in the same way as clock signal Sa. The resultant signal is applied to alarm control transistor 29, thereby actuating the alarm device of the timepiece.

Subsequently, when the next Sr reset pulse is applied to the reset terminal of flip-flop 77, the output of flip-flop 77 returns to the L level. AND gate 78 is thereby inhibited, so that the signal applied to alarm control transistor 29 is cut off, and the alarm signal is ended. It will be apparent that the duration of the alarm signal generated by alarm device 30 can be controlled simply by controlling the period of reset pulses Sr applied to the reset terminal of flip-flop 77, so that a suitable duration for the alarm signal can be obtained. This circuit has the disadvantage, however, that the alarm signal may not be generated at precisely zero seconds, since if coincidence between the current time hours and minutes and the alarm time hours and minutes is detected while switch 49 is already closed (i.e. just after the zero seconds condition has been detected) then a transition from the L to the H level will occur at the clock input terminal of flip-flop 77, causing generation of the alarm signal to begin.

The embodiment shown in FIG. 8 may be adopted in order to overcome the disadvantage described above. Here, separate input circuits 79 and 80 are provided for the zero seconds detection device 49 and the hours and minutes alarm time detection device 44 and form a part of alarm control circuit 19 together with flip-flop 77 and AND gate 78. With this arrangement, the output of input circuit 80 goes from the L level to the H level when coincidence of the current time hours and minutes and the alarm time hours and minutes is detected. Subsequently, when zero seconds detection occurs, the output of input circuit 79 goes from the L level to the H level. As a result, the output of flip-flop 77 goes to the H level, memorizing the H level applied to its data terminal from input circuit 80. The output of AND gate 78 then becomes identical to input signal Sa, and this signal is applied to alarm control transistor 29 thereby actuating alarm device 30. The duration of the alarm signal is determined by the period of the reset pulses Sr applied to the reset terminal of flip-flop 77, as described for the embodiment of FIG. 7 above. It will be apparent that, since the occurrence of an L level to H level transistion at the clock terminal of flip-flop 77 is synchronized with the closing of switch contacts 49, the alarm signal will always begin precisely at the instant of zero seconds being detected.

For the embodiments of FIG. 7 and FIG. 8, the duration of alarm signal generation is determined by the period of clock signal Sr which resets flip-flop 77. If the signal Rs is produced by hours and minutes detection circuit 44, the alarm sound will continue for a time period of about four or five minutes for the reason as mentioned above. In this case, battery power will be wasted in operating the alarm device upon the occasions when the timepiece user forgets to switch off the alarm signal. If, in addition, the period of signal Sr is made shorter than one minute, it is possible for the alarm signal to be cut off by a reset signal pulse applied to flip-flop 77, then to be generated again when the next zero seconds detection occurs. In other words, the alarm signal can be generated twice in succession.

The embodiment shown in FIG. 9 is designed to overcome the above disadvantage of the previously described embodiments of FIG. 7 and FIG. 8, and to ensure that the alarm signal is generated for a period of precisely one minute and then automatically shut off, if the timepiece user omits to shut off the alarm signal manually. In FIG. 9, the minutes and hours alarm time coincidence detection device 44 is connected to the clock terminal of a data-type flip-flop 84, through an input circuit 80. It may be possible to omit input circuit 80 and to connect alarm time coincidence detection device 44 directly to the clock terminal of flip-flop 84. The data terminal of data-type flip-flop 84 is connected to the H level. The Q output terminal of flip-flop 84 is connected to the data terminal of a second data-type flip-flop 86. The clock terminal of flip-flop 86 is connected to zero seconds detection device 49 through input circuit 79. As in the case of input circuit 80, it may be possible to omit input circuit 79 and connect the zero seconds detection device 49 directly to the clock terminal of flip-flop 86. The Q output terminal of flip-flop 86 is connected to the data terminal of a third data-type flip-flop 88, to one input of AND gate 78, and to the reset terminal of flip-flop 84. The output of zero seconds detection output circuit 79 is also connected to the clock terminal of flip-flop 88. The Q output terminal of flip-flop 88 is connected to one input of OR gate 90. Contacts of a switch 96, which is controlled by actuation of an external control member on the timepiece, are connected to OR gate 90 through input circuit 94, which is similar to input circuits 79 and 80. It is possible to omit input circuit 94, and connect switch 96 directly to OR gate 90, if required.

The operation of this circuit will now be described. Prior to time coincidence being detected, the Q outputs of flip-flops 84, 86 and 88 are at the L level. When alarm time coincidence is detected, the output of input circuit 80 will go from the L level to the H level. As a result, since the data terminal of flip-flop 84 is connected to the H level, the Q output of flip-flop 84 will go to the H level and remain there. An H level input is therefore now being applied to the data terminal of flip-flop 86. When zero seconds are detected, the output of zero seconds detection mechanism output circuit 79 will be from the L level to the H level. This transition causes the H level being applied to the data terminal of flip-flop 86 to be memorized, so that the Q terminal of flip-flop 86 goes to the H level and remains there. An H level input is thereby applied simultaneously to an input of AND gate 78 and to the clock input of flip-flop 88. The output of AND gate 78 therefore becomes controlled by signal Sa, so that alarm control transistor 29 is caused to actuate the alarm device. An alarm signal is therefore generated.

The data input terminal of flip-flop 88 is now at the H level. However, since the transition to the H level from the L level took place a short time after the output of input circuit 79 went from the L level to the H level, the Q output of flip-flop 88 is still at the L level at this stage. However, the next time detection of zero seconds occurs, i.e. the next time the output of input circuit 79 goes from the L level to the H level, the H level input applied to the data terminal of flip-flop 88 will cause the Q output of flip-flop 88 to go to the H level. This will occur exactly one minute after alarm signal generation has begun. Since the Q output of flip-flop 88 is connected to OR gate 90, an H level input will be applied to the reset terminal of flip-flop 86. Flip-flop 86 will therefore be reset so that AND gate 78 is inhibited, and signal Sa is no longer transferred to alarmcontrol transistor 29. The alarm signal will therefore be cut off. Flip-flop 84 is already reset, by the previous H level of the Q output from flip-flop 86 being applied to its reset terminal. It will be apparent that the Q output of flip-flop 84 cannot go to the H level again until alarm time coincidence is once more detected. Thus, there is no possibility of unwanted triggering of the alarm after it has been shut off.

After flip-flop 86 has been reset by the Q output of flip-flop 88 through OR gate 90, the Q output of flip-flop 88 will remain at the H level until the next time zero seconds detection occurs, i.e. for one minute. During this time, flip-flop 86 will be held in the reset condition. This may be undesirable, in some cases. To overcome this problem, the inverted output $\overline{Q}$ of flip-flop 86 can be connected to the reset terminal of flip-flop 88, as indicated by the broken line in FIG. 9. If this is done, then when flip-flop 86 is reset by the output of flip-flop 88 applied through OR gate 90, the $\overline{Q}$ output of flip-flop 86 will go to the H level, thereby resetting flip-flop 88. Thus, flip-flop 86 is now controlled by the inputs applied to its clock and data terminals.

If it is desired to be able to establish any desired duration of alarm signal generation, this can be done by the embodiment shown in FIG. 10. Here, the $\overline{Q}$ output of flip-flop 86 is connected to the reset terminal of a counter circuit 100. Clock signal Ss is applied to the clock terminal of counter circuit 100, the output terminal of which is connected to the reset terminal of flip-flop 86 through OR gate 90. Normally, counter circuit 100 is held in the reset condition by an H level input applied to its reset terminal from the $\overline{Q}$ output of flip-flop 86. The output of counter circuit 100 is therefore at the L level. When alarm time coincidence and zero seconds are detected, however, the $\overline{Q}$ output of flip-flop 88 goes to the L level, thereby releasing the reset condition of counter circuit 100. Counter circuit 100 therefore now begins to count clock pulses Ss. Thus, after a certain time, whose duration is determined by the frequency of signal Ss and the number of stages in counter 100, the output of counter 100 will go to the H level. Flip-flop 86 is therefore reset through OR gate 90. This causes the Q output of flip-flop 86 to go to the L level, inhibiting AND gate 78 and causing the alarm signal to be shut off.

It should be noted that circuit components which are identical to those in the embodiment of FIG. 9 have been omitted from FIG. 10, for the purposes of clarity of description.

Although a mechanical type of zero seconds detection mechanism has been assumed to be used, for the purposes of describing the above embodiments, the scope of the present invention also covers magnetic-mechanical and opto-mechanical types of zero seconds detection devices.

What is claimed is:

1. An electronic timepiece having a source of a standard frequency signal, frequency divider means for dividing a frequency of said standard frequency signal to produce a standard frequency time signal, analog type current time indication means driven by said standard time signal for indicating current time, analog type alarm time indication means for indicating an alarm time, and external operating means coupled to said alarm time indication means for setting said alarm time, comprising:

alarm time coincidence detection means coupled to said current time display means and to said alarm time indication means for detecting coincidence between the hours and minutes of said current time and the hours and minutes of said alarm time and for generating an alarm time coincidence signal when such coincidence is detected;

zero seconds detection means coupled to said current time display means for detecting when the seconds of current time become zero and for producing a zero seconds detection signal when said seconds of current time become zero;

alarm control circuit means responsive to said alarm time coincidence signal and said zero seconds detection signal for producing an alarm drive signal; and alarm generation means responsive to said alarm drive signal for generating an alarm drive signal;

said alarm time coincidence detection means including a first set of switch contacts for detection of alarm time hours coincidence and a second set of switch contacts for detection of alarm time minutes coincidence, said first set of switch contacts being closed when alarm time hours coincidence occurs and said second set of switch contacts being closed when alarm time minutes coincidence occurs, and wherein said zero seconds detection means includes a third set of switch contacts, said third set of switch contacts being closed when zero seconds of said current time occurs.

2. An electronic timepiece according to claim 1, wherein said first set of switch contacts, said second set of switch contacts and said third set of switch contacts are connected in series with said alarm control circuit means and with said alarm generation means such that current flows through said alarm generation means when said first, second and third sets of switch contacts are simultaneously closed, the character of said current being determined by said clock signal applied to said alarm control circuit means.

3. An electronic timepiece according to claim 1, wherein said first set of switch contacts, said second set of switch contacts and said third set of switch contacts are connected in series, and further comprising:

memory circuit means responsive to a signal produced by simultaneous closing of said first, second and third sets of switch contacts for producing an output signal continuing for a predetermined time duration following said simultaneous closing; and logic gate means responsive to said clock signal and to said output signal from said memory circuit means for producing said alarm drive signal.

4. An electronic timepiece according to claim 1, and further comprising:

first, second and third memory circuit means responsive to signals produced by closing of said first, second, and third sets of switch contacts respectively for producing first, second and third output signals; and logic gate means for generating the logical product of said first, second and third output signals and of said clock signal to produce said alarm drive signal.

5. An electronic timepiece having a source of a standard frequency signal, frequency divider means for dividing a frequency of said standard frequency signal to produce a standard frequency time signal, analog type current time indication means driven by said standard time signal for indicating current time, analog type alarm time indication means for indicating an alarm time, and external operating means coupled to said alarm time indication means for setting said alarm time, comprising:

alarm time coincidence detection means coupled to said current time display means and to said alarm time indication means for detecting coincidence between the hours and minutes of said current time and the hours and minutes of said alarm time, and for generating an alarm time coincidence signal when such coincidence is detected;

zero seconds detection means coupled to said current time display means for detecting when the seconds of current time become zero and for producing a zero seconds detection signal when said seconds of current time become zero;

alarm control circuit means responsive to said alarm time coincidence signal and said zero seconds detection signal for producing an alarm drive signal;

said alarm time coincidence detection means including first switch means for detection of alarm time hours coincidence and second switch means for detection of alarm time minutes coincidence, said first switch means being closed when alarm time hours coincidence occurs and said second switch means being closed when alarm time minutes coincidence occurs, and wherein said zero seconds detection means includes third switch means, said third switch means being closed when zero seconds of current time occurs.

6. An electronic timepiece as claimed in claim 5, in which said first, second and third switch means comprise a first, a second and a third set of switch contacts respectively.

7. An electronic timepiece as claimed in claim 6, in which said first set of switch contacts, said second set of switch contacts and said third set of switch contacts are connected in series, and further comprising:

memory circuit means responsive to a signal produced by simultaneous closing of said first, second and third sets of switch contacts for producing an output signal continuing for a predetermined time duration following said simultaneous closing; and logic gate means responsive to said clock signal and to said output signal from said memory circuit means for producing said alarm drive signal.

8. An electronic timepiece as claimed in claim 6, and further comprising:

first, second and third memory circuit means responsive to signals produced by closing of said first, second and third sets of switch contacts respectively for producing first, second and third output signals; and logic gate means for generating the logical product of said first, second and third output signals and of said clock signal to produce said alarm drive signal.

* * * * *